US006125503A

United States Patent [19]

Callahan

[11] Patent Number: 6,125,503

[45] Date of Patent: Oct. 3, 2000

[54] RETRACTING ROTATIONAL BACKPACK BLOWER AIR DISCHARGE TUBE UNIT

[75] Inventor: Michael D Callahan, Marathon, Fla.

[73] Assignee: Az-Tech Research and Development Corporation, Marathon Shores, Fla.

[21] Appl. No.: 09/076,475

[22] Filed: May 12, 1998

[51] Int. Cl.[7] ..... A47L 9/08

[52] U.S. Cl. ..... 15/414; 15/405; 15/327.5

[58] Field of Search ..... 15/405, 414, 144.2

[56] References Cited

U.S. PATENT DOCUMENTS

| | | | |
|---|---|---|---|
| 2,623,234 | 12/1952 | Brown | 15/414 X |
| 3,244,437 | 4/1966 | Belicka et al. | 15/414 X |
| 3,938,218 | 2/1976 | DeAmicis | 15/414 X |
| 4,746,274 | 5/1988 | Kiyooka et al. | 15/405 X |

*Primary Examiner*—Chris K. Moore

[57] ABSTRACT

A device for promoting safe, comfortable, economical, and timely use of all currently manufactured, new in stock and used backpack blowers, by using this retracting rotational backpack blower air discharge tube unit (1) that utilizes one section of blower air discharge tubing, wherein the retracting rotational backpack blower tube unit (1) being larger in inside dimension than the outside dimension of a modified backpack blower straight tube, while the retracting rotational backpack blower tube unit (1), will retract in effect over a modified backpack blower straight tube when the upper longitude end of said is attached to a backpack blower discharge air flex tube, as to become a ridged fixed means, thus allowing the retracting rotational backpack blower tube unit (1), to retract and extend by longitudinal means over a modified backpack blower straight tube as to the full length of said when controlled by the hand of the operator while a modified backpack blower straight tube becomes a ridged fixing axis point means for the retracting rotational backpack blower tube unit (1), as said becomes the means, to circumference three hundred and sixty degrees minus or plus at all axis means of a modified backpack blower straight tube, therefore, directing discharge air flow of a backpack blower using angular means of the retracting rotational backpack blower tube unit (1), that incorporates a lower angular means curvature, from any three hundred and sixty degree horizontal or vertical angular means of the retracting rotational backpack blower tube unit (1) on demand by the hand action of the operator.

1 Claim, 4 Drawing Sheets

DIRECTIONAL ROTATABLE RETRACTABLE EXTENDABLE RECEIVABLE BACKPACK BLOWER AIR DISCHARGE TUBE UNIT
HORIZONTAL OPERATING VIEW

RETRACTING ROTATIONAL BACKPACK BLOWER AIR DISCHARGE TUBE UNIT

RETRACTING ROTATIONAL BACKPACK BLOWER AIR DISCHARGE TUBE UNIT

DIRECTIONAL ROTATABLE RETRACTABLE EXTENDABLE RECEIVABLE BACKPACK BLOWER AIR DISCHARGE TUBE UNIT
HORIZONTAL OPERATING VIEW

RETRACTING ROTATIONAL BACKPACK BLOWER AIR DISCHARGE TUBE UNIT

BACKGROUND FIELD OF INVENTION

The background field for this invention is, a backpack blower air discharge tube unit.

BACKGROUND DESCRIPTION OF PRIOR ART

Backpack blowers are designed with a multiple blade fan energized by a self contained fuel engine or electric motor strapped to the back of a person with air discharge directed through an extended blower tube assembly. These backpack blowers are generally used to remove yard debris from hard surfaces, example; sidewalks, driveways, parking areas, flights of stairs, etc.

The current backpack blower air discharge tubes are sectional in length and not adjustable. Backpack blower tubes are currently manufactured in two styles. One with an engine speed control mounted midway down the blower tube, (FIG. 5), and the second one is a plain blower tube (FIG. 6). These said blower tubes are front projection only, causing the operator to move forward while moving the tube sideways at angles of thirty degrees or less. The operator must move sideways in a crab like movement to relocate debris past a thirty degree angle plus or minus of forward center. This abnormal movement can cause excessive strain on all lower and upper extremity body joints.

The use for said on flights of stairs is very dangerous. When used on stairs ascending is close to impossible do to the long non adjustable blower tube. Descending the flight of stairs with the long non retracting, non rotating blower tube is difficult without the downward direction for the operator to direct air flow down the stairs. The operator has three options when descending stairs:

1: Back down and direct air forward, which directs the debris up the stairs and into the face of the operator, reducing the debris removal to a waste of time and energy.

2: Descending down in a straight foreword movement unable to direct the debris in any direction as the directed air flow does not angle down to remove the debris.

3: Descending in a sideways movement that directs the discharge air flow into the side wall of the stair, leaving the opposite side with negative results.

Using the current backpack blowers in congested areas becomes a tripping hazard. Moving around objects is dangerous when the blower tube end comes into contact with a non movable object.

The current practice with most operators of backpack blowers is to remove the lower one or two sections of blower tube. This makes for an uncontrollable non directional scattering wide pattern that may cause personal injury or property damage. When using the said shortened blower tube in a parking lot around automobiles, the air is not directed under the automobile leaving unwanted debris when the automobile is moved.

With all the current backpack blowers, the operator must face the debris at all times, thus forcing constant movement and repositioning of the whole body causing unnecessary operator strain and energy loss.

OBJECTS AND ADVANTAGES

It is an object of the invention to reduce the injuries, discomfort and strain, on the whole body of the operator while saving time, energy, and fuel when using a backpack blower.

(a) The retracting rotational backpack blower air discharge tube unit according to the invention, makes it possible to achieve a large degree pivot and circumference while standing still or moving about in any direction when extending, retracting and rotating the retracting rotational backpack blower tube. This action enables the operator to quickly adjust the length of the retracting rotational backpack blower tube by simply moving their air forward or backward at any speed while grasping said with their hand. This natural movement, without requiring body repositioning, will reduce strain on the associated connected joints and tendons.

(b) With the retracting rotational backpack blower tube according to the invention, the operator is now able to operate a backpack blower in small congested areas, do to the retracting rotational means of the invention, allowing greater mobility with less chance of injury to the operator from entanglement with stationary objects, when using the retracting rotational backpack blower tube.

(c) The retracting rotational backpack blower tube according to the invention, creates quick and easy effortless longitude blower tube control that allows complete circumferencing while reducing time, energy and fuel consumption per square foot of area to be cleared of debris.

(d) Controlling the angular direction of debris removal provided by the retracting rotational backpack blower tube, the operator can lessen the chance of personal injury and property damage.

The invention addresses the problems of safety, operator fatigue, fuel savings, and time reduction.

DRAWING FIGURES

An exemplary embodiment of the invention is described below with reference of the drawings in which.

Figure 3A:
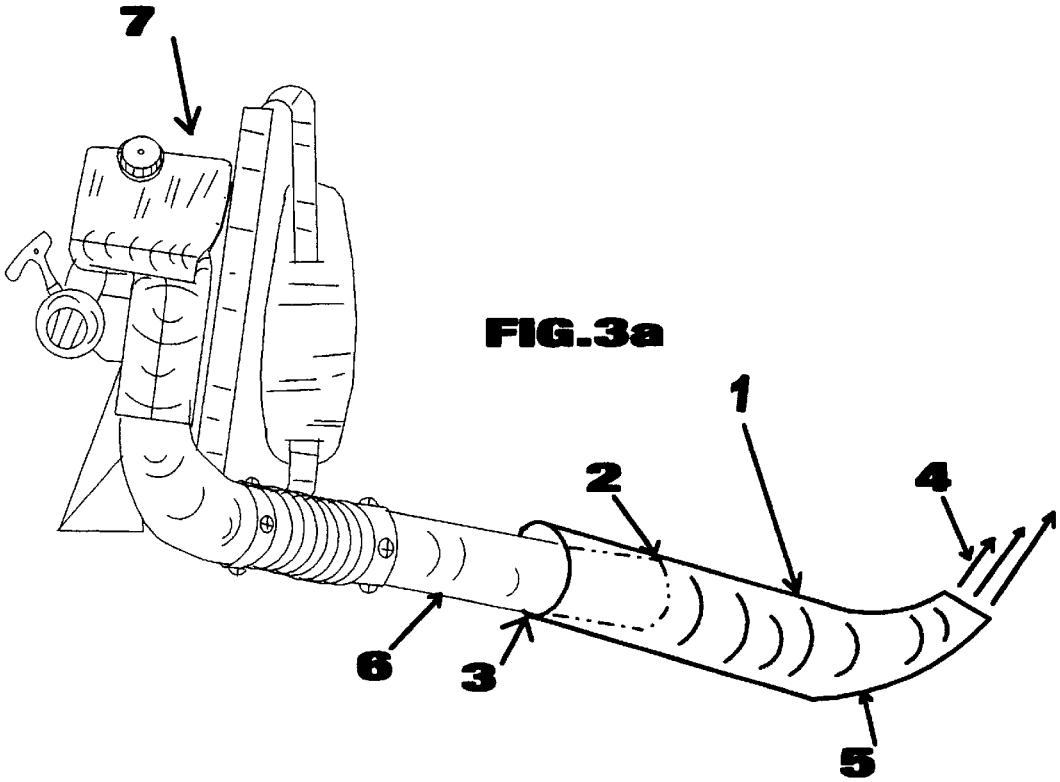

FIG. 3*a* is a typical embodiment of the directional rotatable retractable extendable backpack blower receivable tube unit invention as illustrated in a horizontal operational view.

Figure 1:
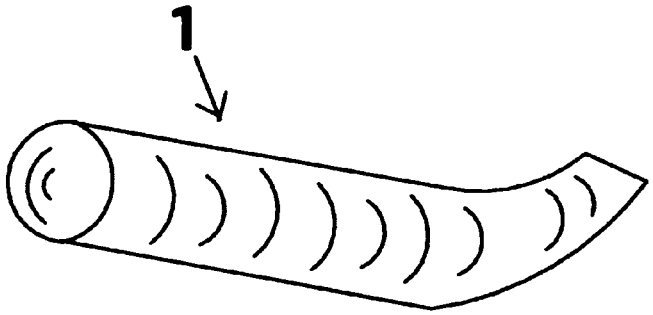
FIG. 1 is an overall view of the retracting rotational backpack blower air discharge tube unit.
Figure 2:
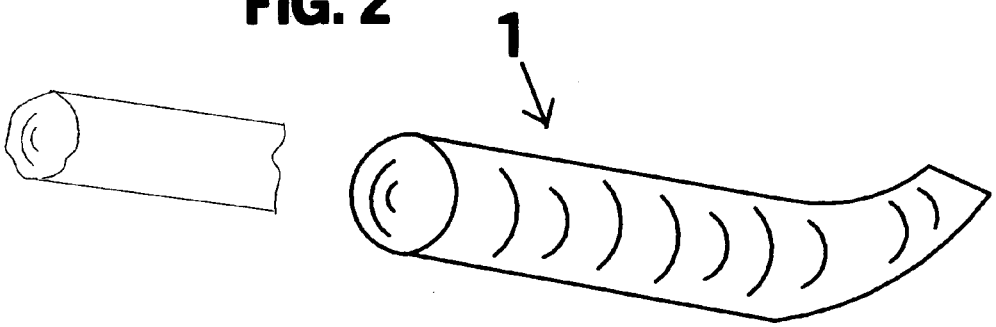
FIG. 2 is an overall view of the retracting rotational backpack blower air discharge tube unit removed from a modified backpack blower straight tube.
Figure 3:
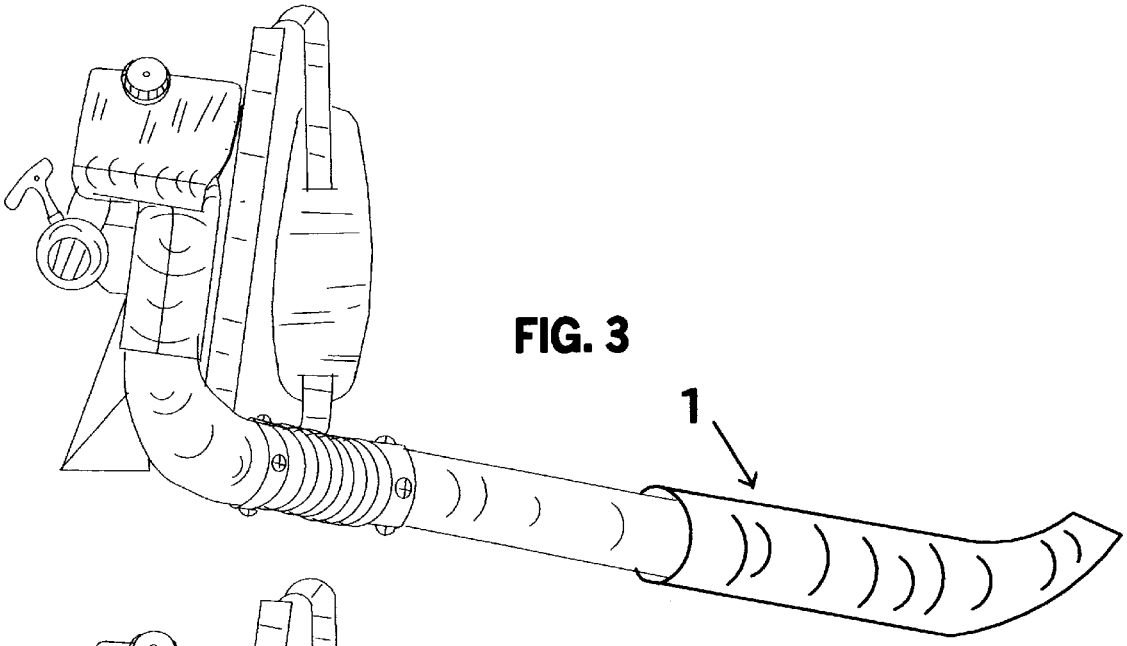
FIG. 3 is the retracting rotational backpack blower air discharge tube unit, in the fully extended position over the modified straight blower tube of a backpack blower.
Figure 4:
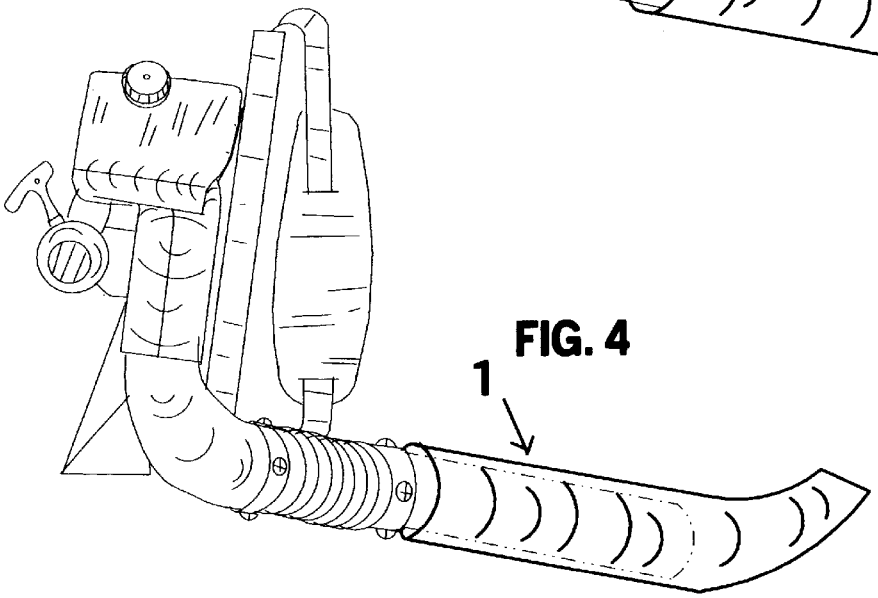

FIG. 4 is the retracting rotational backpack blower air discharge tube unit, in the fully retracted position over the modified straight blower tube of a backpack blower.

Figure 5:
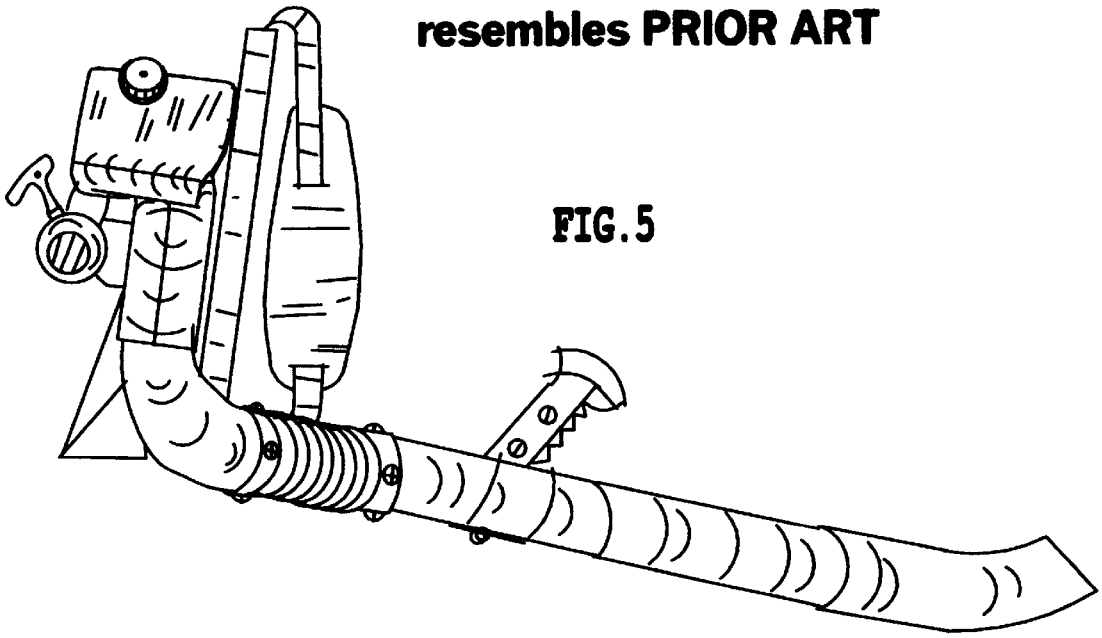

FIG. 5 resembles PRIOR ART of a currently manufactured backpack blower with an engine speed control mounted on the non adjustable blower tube.

Figure 6:
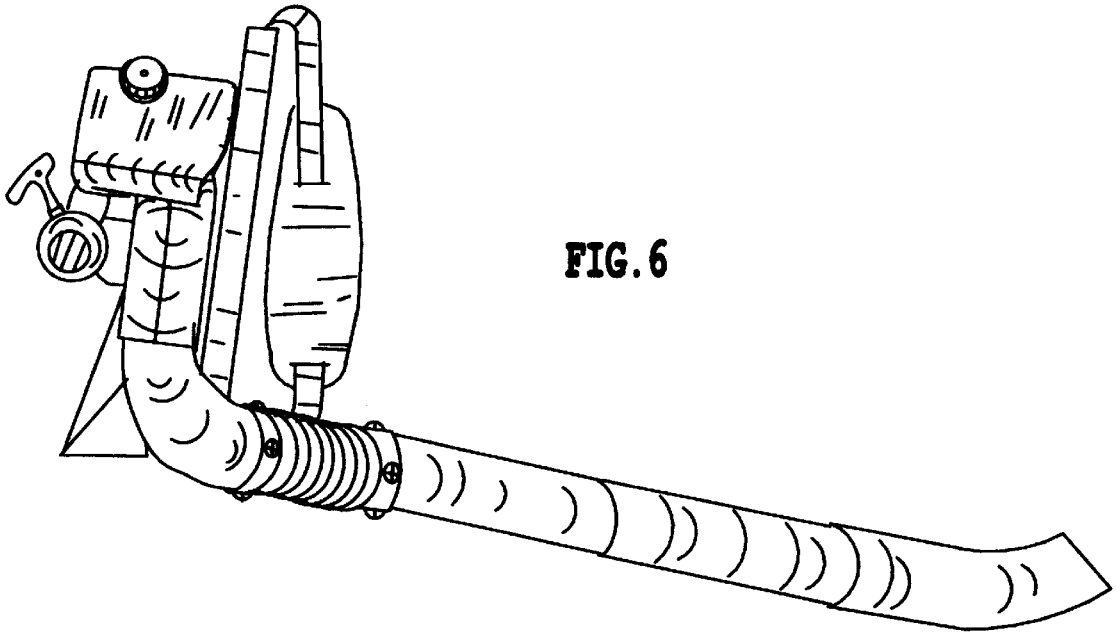

FIG. 6 resembles PRIOR ART of a currently manufactured backpack blower with non adjustable plain backpack blower tube.

DESCRIPTION OF A PREFERRED EMBODIMENT

Referring to FIG. 3*a*, the rotatable telescoping blower air discharge extension tube 1 is shown mounted on a backpack blower discharge tube 6. The difference in diameters of the discharge tube 6 and the extension tube 1 of the invention is exaggerated to show the means by which the extension tube is releasably locked longitudinally on the discharge tube 6. Since the extension tube 1 is larger in inside diameter than the outside diameter of the discharge tube 6, the extension tube 1 may be easily slid along the discharge tube 6 and rotated thereon when the backpack blower 7 is either shut off or operating at low idle. When the blower 7 is operated at higher speeds, air issuing from the off-axis exit 4 of the curved end 5 of the extension tube 1 exerts a sideways force on the extension tube. This force causes the coaxially positioned tubes 6 and 1 to become axially unaligned, bringing the inner surface of the outer end of the discharge tube 6 into forceful contact with a point 2 on the inner surface of the extension tube 1, and likewise, a point 3 on the outside of the discharge tube 6 into contact with the inner surface of the end of tube 1 proximal to the operator. The considerable force of the air issuing from the exit 4 of the extension tube 1 causes the friction at the two contact points 2 and 3 to lock the two tubes 6 and 1 against relative axial or rotary movement with each other, creating a frictional locking means between the tubes.

OPERATION FIGS. 1 TO 3

Assembly of the retracting rotational backpack blower air discharge tube unit is attained by inserting the upper longitude end of the retracting rotational backpack blower tube unit over the lower longitude end of a modified backpack blower straight tube.

SUMMARY, RAMIFICATIONS AND SCOPE

It is an object of the invention to reduce the injuries, discomfort and strain, on the whole body of the operator while saving time, energy, and fuel when using a backpack blower.

(a) The retracting rotational backpack blower air discharge tube unit according to the invention, makes it possible to achieve a large degree pivot and circumference while standing still or moving about in any direction when extending, retracting and rotating the said retracting rotational backpack blower tube enabling the operator to quickly adjust the length of the retracting rotational backpack blower tube by simply moving their arm forward or backward at any speed while grasping said with their hand, therefore reducing strain on the associated connected joints and tendons.

(b) With the retracting rotational backpack blower tube according to the invention, the operator is now able to operate a backpack blower in small congested areas allowing greater mobility with less chance of injury to the operator from blower tube entanglement with stationary objects, when using the retracting rotational backpack blower tube.

(c) The retracting rotational backpack blower tube according to the invention, creates quick and easy effortless longitude blower tube control that allows complete circumferencing while reducing time, energy and fuel consumption per square foot of area to be cleared of debris.

(d) The retracting rotational backpack blower tube invention, will create the opportunity for all backpack blowers currently being manufactured, and the upgrading of used backpack blowers, to become a safe and efficient retracting rotational backpack blower.

(e) When the manufacturing of backpack blower tubes changes to the production of the retracting rotational backpack blower tube unit, the tube industry will maintain its current production rate except for the increase of upgrading retracting rotational backpack blower tube units being in demand from used backpack blowers.

Although the description above contains many specificities, these should not be construed as limiting the scope of the invention but as merely providing illustrations of some of the presently preferred embodiments of this invention. As implied, it is the lengthening, shortening and angular rotating at will by the operator, that makes the retracting rotational backpack blower tube unit address the problems of safety, operator fatigue, fuel savings, and time reduction.

Thus the scope of the invention should be determined by the appended claims and their legal equivalents, rather than by the examples given.

What is claimed is:

1. A directional rotatable telescoping blower air discharge extension tube for operator-supported blowers; the extension tube having a substantially straight main portion, and said extension tube being curved at the outlet end thereof to cause air exiting therefrom to issue at an angle to the direction which air travels through said main portion; the inner diameter of said extension tube being adapted to be dimensioned relative to the outer dimension of the blower discharge tube such that the extension tube may be freely telescoped over a substantial portion of the length of said discharge tube, while a frictional locking means between the two tubes is created when the blower is operated at relatively high speed to causes a forceful discharge of air to issue from said curved outer end of said extension tube.

* * * * *